United States Patent [19]

Boofer

[11] 4,067,579

[45] Jan. 10, 1978

[54] BOARD GAME AND ADVERTISING DISPLAY

[75] Inventor: George McCoy Boofer, Stockton, Calif.

[73] Assignee: Sandstorm Enterprises Inc., Stockton, Calif.

[21] Appl. No.: 698,400

[22] Filed: June 21, 1976

[51] Int. Cl.[2] ..... A63F 3/04

[52] U.S. Cl. ..... 273/254 GA

[58] Field of Search ..... 273/134

[56] References Cited

U.S. PATENT DOCUMENTS

| | | | |
|---|---|---|---|
| 1,346,826 | 7/1920 | Huggins | 273/134 AC |
| 1,529,908 | 3/1925 | Newcombe | 273/134 AC |
| 2,185,556 | 1/1940 | Johnson | 273/134 AE |

FOREIGN PATENT DOCUMENTS

| | | | |
|---|---|---|---|
| 1,139,866 | 2/1957 | France | 273/134 AC |

*Primary Examiner*—Delbert B. Lowe

*Attorney, Agent, or Firm*—Townsend and Townsend

[57] ABSTRACT

A game apparatus comprising a game board having a playing field comprising a map, a plurality of terminals, a plurality of routes across the map, each route extending between a pair of terminals and divided into a plurality of playing spaces some of which bear instructional indicia; a plurality of cards from among which a player draws one or more cards bearing indicia instructing the player; a plurality of playing tokens (such as miniature trucks) for representing a player's location on the playing field; a die for randomly designating the number of playing spaces to be moved by a player along one of the routes during the player's turn; and imitation money for transactions calling for payment or receipt of money during the course of play. Advertising copy related to the trucking industry is displayed on the game board.

12 Claims, 2 Drawing Figures

BOARD GAME AND ADVERTISING DISPLAY

BACKGROUND OF THE INVENTION

Board games in which a playing board is illustrated with a map of a political entity, such as the United States, with various transportation routes thereon, are known in the art. Commonly, the objective of such a game is to travel between the selected starting point and one or more destinations, with the first player reaching the destination declared as the winner. Such map board games not only supply entertainment, but have educational value because of the geographical knowledge which is imparted to the player.

The present game relates to such prior games in that it involves travel across a map, but differs from such prior games in a number of respects including the fact that it relates to commercial trucking. The present game is imitative of commercial trucking in many respects and, yet, is fanciful in other respects, whereby such game provides further educational and entertainment benefits.

SUMMARY OF THE INVENTION

The present invention utilizes a game board, which may be of a rigid material, or of a flexible material which may be rolled or folded. The game board has a playing field upon it which includes a map of a political entity, such as continental United States. The map may also include such details as the boundaries of various states, the locations of various cities within the states, and the locations of geographic features such as mountains, lakes and rivers.

In addition, the playing field includes a plurality of truck routes which run across the map between terminals at opposite borders of the map. These routes intersect one another and separate terminals are provided for each route.

Each route is divided into a plurality of playing spaces, certain of which bear indicia relating to play of the game, eg. indicia instructing a player landing on such space to pay or receive money, to delay or advance the progress of his token along the route, to select one of a group of playing cards bearing further instructions to be carried out by the player, etc. Other playing spaces may be blank, but preferably would contain decorative or humorous material.

Each player is provided with a token, such as a miniature truck, for indicating his position or location on the playing field.

A random selection device, such as a die, is used for determining the number of spaces which a player may advance along the route during his turn.

A plurality of route cards are provided which instruct the player to take a particular route across the board between two terminals, and to pick up and/or drop off all or portions of his "load" of goods at specified locations along the route. Such route cards further instruct the player as to the amount of money which he must pay for fuel and brokerage charges at the end of his run.

Instructional indicia appearing along the various truck routes, or on playing cards, are intended to correspond to real-life events or experiences of a commercial truck driver. By this device, it is an object of the present invention to provide a game which is imitative of the experiences of a commercial truck driver in the practice of his trade, thereby providing educational and instructional experiences for the player of the game. Nevertheless, real life experience has not been slavishly followed so as to be precisely imitative of trucking experience; liberties have been taken to maximize the entertainment value of the game for the player.

The present invention is also directed to a novel form of advertising. Games which depict real-life experiences are well known. Such games are typically played repeatedly, thereby providing repeated exposure of players to the playing field of the game board. Such repeated exposure provides opportunities for useful display of advertising copy of a type where repeated exposure is desired. For example, in a trucking game of the sort described herein, the game board may be printed with the trade symbols of manufacturers and/or suppliers of goods and/or services related to the trucking industry. Repeated exposure of the players to such trade symbols can have the effect of familiarizing the players with such symbols and with the products and/or services which they represent.

Such advertising copy can be related in content to the theme of the game, thereby maximizing impact and, to an extent, displaying such copy to persons, a relatively large percentage of whom might be presumed to have a need for the goods and/or services involved. For example, where the trucking game board of the present invention displays advertising of the trucking industry, it might be assumed that a relatively high percentage of players will be truckers and families of truckers, thereby helping to maximize cost effectiveness of such advertising.

BRIEF DESCRIPTION OF THE DRAWINGS

FIG. 1 further depicts the location of advertising indicia around the perimeter of the game board and elsewhere; and playing pieces including miniature trucks which serve as tokens for the players, chips which serve as recording pieces, a die, imitation money, and playing cards bearing instructional indicia.

DETAILED DESCRIPTION OF THE PREFERRED EMBODIMENTS

I. Game Apparatus

The apparatus of the invention, as generally described above, comprises a game board having a playing field comprising a map, a plurality of terminals, and a plurality of routes across said map, each route extending between a pair of terminals and divided into a plurality of playing spaces some of which bear instructional indicia; means (such as a plurality of cards from among which a player draws one or more cards bearing indicia instructing the player) for providing randomly selected instructions to players; a plurality of playing tokens (such as miniature trucks) for representing a player's location on the playing field; means (such as a die) for randomly designating the number of playing spaces to be moved by a player along one of said routes during the player's turn; and imitation money for carrying out transactions calling for payment or receipt of money during the course of play. These components are described in greater detail following.

Figure 1:
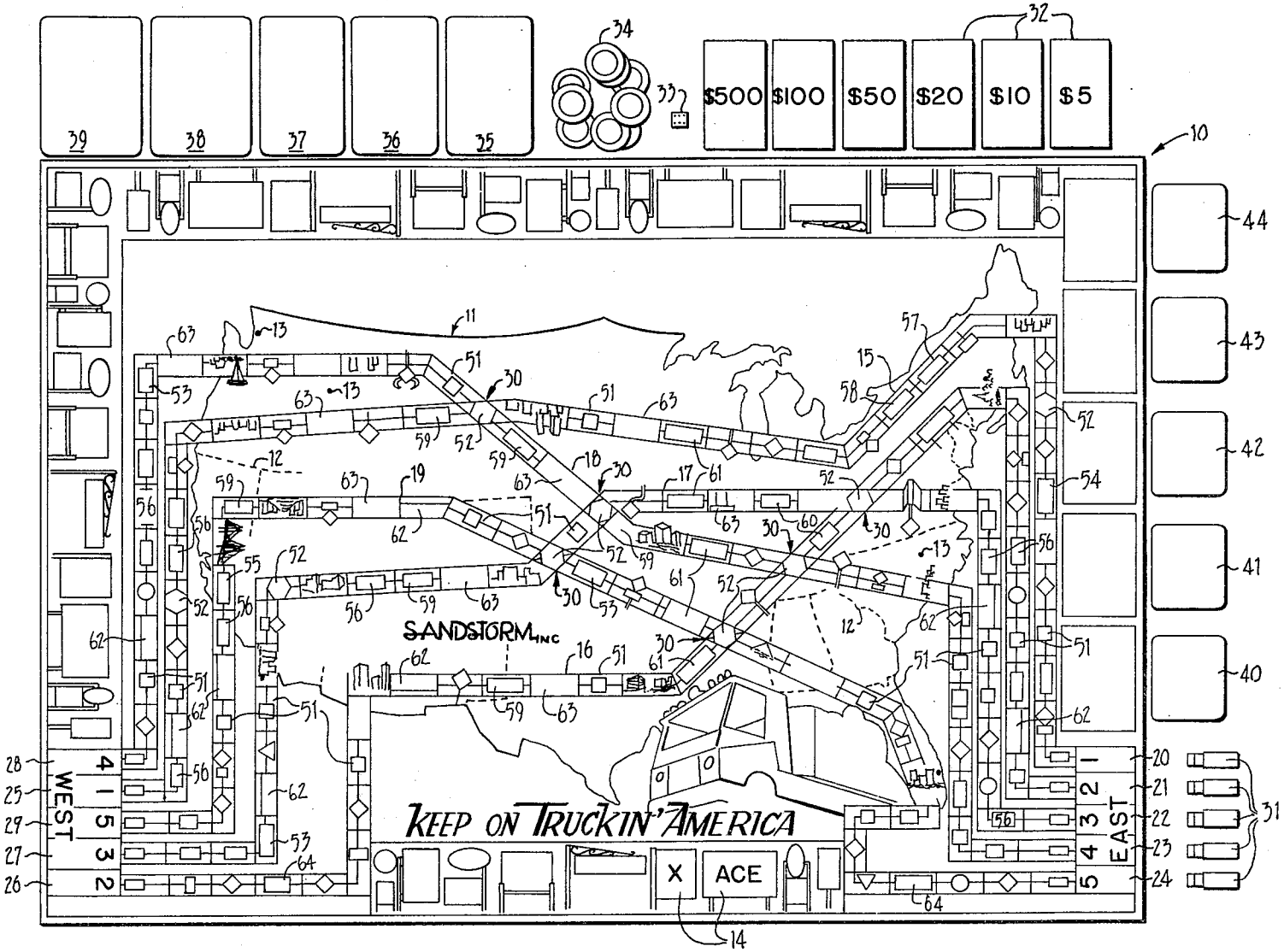
FIG. 1 is an illustration of the playing board of the game of the present invention, wherein various truck routes extend between terminals across a map of the United States.

A board for the game is illustrated diagrammatically in FIG. 1. The map shown may be printed or adhered on a rigid surface such as cardboard, plastic or the like, or may instead be imprinted upon a foldable or rollable material, such as plastic, cloth, or the like. Irrespective of the medium upon which the map is displayed, it is hereafter designated as a "game board." FIG. 1 shows the game board 10 as having imprinted thereupon a map 11 of the continental United States, showing the boundaries 12 of the 48 states, and illustrating major cities 13. Because of the limited scale of the map 11 as illustrated in FIG. 1, only selected ones of the cities and state borders are shown, but it will be appreciated that the full scale map upon which the game is to be played can have sufficient detail so that it will illustrate a variety of geographic features and have geographical educational value.

FIG. 1 further shows five truck routes 15–19, each traversing the map in a generally east-west direction, and extending between terminals 20–24 at the right-hand side of the board and terminals 25–29, respectively, at the left-hand side of the board. Each of the truck routes intersects at least one of the other truck routes at an intersection 30.

The game board further includes advertising indicia 14 around the perimeter of the board 10. Fictitious trade symbols "ACE" and "X" serve as representative advertising indicia 14. In practice, the game board would display actual trade symbols or advertising indicia of existing companies, preferably those manufacturing and/or supplying goods and/or services to the trucking industry.

FIG. 1 further depicts additional components of the game as follows: 5 miniature trucks 31 serve as playing tokens for representing each of up to 5 players' locations along the truck routes 15–19. Six stacks of imitation currency 32 in denominations of $5.00, $10.00, $20.00, $50.00, $100.00 and $500.00 serve as means for recording transactions calling for payment or receipt of money. A die 33 serves as a means for randomly designating the number of playing spaces to be moved by a player along one of the routes 15–19 during the player's turn. A plurality of poker chips 34 or the like serve as means for recording or keeping track of turns to be forfeited by a player as a penalty. Stacks of playing cards 35–39 bear instructional indicia governing advancement or delay of movement of the trucks 31 along the routes 15–19; and payment or receipt of money by the player drawing the card.

Stack 35 consists of 18 cards, each bearing the title "SMOKEY SEZ" and imprinted on one side with instructions as follows:

1. YOU'RE BUSTED: I.C.C. LOG BOOK CHECK, YOU'RE IN VIOLATION . . . PAY FINE OF $100.00 TO BANK . . . MISS ONE TURN, TAKE ONE CHIP . . . .
2. BAD LUCK: BAD AND SEVERE WEATHER, ICE AND SNOW WITH BLOWING DRIFTS, AND REDUCED VISIBILITY . . . ROAD CLOSED, PAY MOTEL BILL OF $100.00 TO THE BANK . . . MISS ONE TURN, TAKE ONE CHIP . . . .
3. YOU'RE BUSTED: FOR SPEEDING . . . PAY FINE OF $75.00 TO BANK . . . REMEMBER TO SLOW DOWN IN FOG, SNOW OR WET WEATHER . . .
4. YOU'RE BUSTED: FOR RUNNING A STOP SIGN . . . PAY FINE OF $100.00 TO BANK . . . MISS ONE TURN, TAKE ONE CHIP . . . REMEMBER: COME TO A FULL STOP AT STOP SIGNS AND LIGHTS . . . .
5. YOU'RE BUSTED: FOR ILLEGAL PASSING . . . PAY FINE OF $100.00 TO BANK . . . REMEMBER: THINK TWICE BEFORE YOU PASS, DON'T PASS ON A HILL CREST OR BLIND TURN . . . .
6. YOU'RE BUSTED: HELICOPTER HAS CLOCKED YOUR RIG AT AN EXCESSIVELY HIGH SPEED . . . PAY FINE OF $100.00 TO BANK . . . MISS 2 TURNS, TAKE 2 CHIPS . . . FASTEN YOUR SEAT BELT BEFORE YOU DRIVE . . . .
7. YOU'RE BUSTED: FAILURE TO YIELD RIGHT OF WAY . . . PAY FINE OF $750.00 TO BANK . . . MISS ONE TURN, TAKE ONE CHIP . . . REMEMBER: DRIVE DEFENSIVELY, COURTESY IS CONTAGIOUS . . . .
8. YOU'RE BUSTED: SPEEDING THROUGH RADAR, 20 MPH OVER SPEED LIMIT . . . PAY FINE OF $50.00 TO BANK . . . MISS ONE TURN TAKE ONE CHIP . . . REMEMBER: DON'T DRIVE FASTER THAN CONDITIONS ALLOW . . . .
9. YOU'RE BUSTED: FOR BEING IN THIRD LANE . . . PAY FINE OF $50.00 TO BANK . . . .
10. YOU'RE BUSTED: FOR RUNNING UNSAFE EQUIPMENT . . . PAY FINE OF $50.00 TO BANK . . . REMEMBER: BE SURE ALL YOUR LIGHTS ARE WORKING AND BRAKES ARE IN PROPER ADJUSTMENT . . . .
11. YOU'RE BUSTED: FOR BEING IN THIRD LANE . . . PAY FINE OF $50.00 TO BANK . . . .
12. BAD LUCK: TWO TIRES BLOWN OUT . . . PAY $25.00 ROAD SERVICE, AND $250.00 FOR TIRES . . . PAY TOTAL $275.00 TO THE BANK . . . MISS ONE TURN, TAKE ONE CHIP . . . .
13. BAD LUCK: REAR END SHOT: PINION AND RING GEAR RUINED . . . PAY $800.00 TO BANK FOR REPAIRS . . . MISS ONE TURN, TAKE ONE CHIP . . . .
14. BAD LUCK: TRANSMISSION BLOWN . . . PAY REPAIR BILL OF $900.00 TO BANK . . . PAY $50.00 ROAD SERVICE COSTS . . . PAY TOTAL $950.00 TO BANK. . . .
15. YOU'RE BUSTED: FOR TRYING TO SNEAK THROUGH THE STATE WITH AN EXPIRED PERMIT . . . MISS 2 TURNS, TAKE 2 CHIPS . . . .
16. REFRIGERATOR UNIT FAILURE: PERISHABLE CARGO IS A TOTAL LOSS . . . DO NOT COLLECT ANY WAGES FOR THIS LOAD . . . BE SURE TO PAY BANK FUEL AND BROKERAGE FEES SHOWN ON THE DISPATCH CARD YOU ARE NOW USING FOR THIS TRIP . . . .
17. BAD LUCK: CAUGHT BEHIND ACCIDENT, ALL LANES OF FREEWAY ARE BLOCKED . . . MISS ONE TURN, TAKE ONE CHIP . . . .
18. BAD LUCK: CAUGHT BEHIND ACCIDENT, ALL LANES OF FREEWAY ARE BLOCKED . . . MISS ONE TURN, TAKE ONE CHIP . . . .

Stack 36 consists of 18 cards entitled "BONUS" and bearing the following instructions:

1. BAD LUCK: BROKEN DRIVE AXLE . . . PAY $100.00 TO BANK FOR REPAIRS . . . .
2. BAD LUCK: RUPTURED FUEL TANK . . . PAY $50.00 TO THE BANK FOR REPAIRS. MISS ONE TURN, TAKE ONE CHIP . . . .
3. JACKPOT: KENO IN RENO . . . THIS IS YOUR LUCKY DAY . . . YOU WIN $200.00 . . . COLLECT FROM THE BANK . . . KEEP ON TRUCKIN . . . .
4. JACKPOT: KENO IN RENO . . . THIS IS YOUR LUCKY DAY . . . YOU WIN $200.00 . . . COLLECT FROM THE BANK . . . KEEP ON TRUCKIN . . . .
5. JACKPOT: THIS IS YOUR LUCKY DAY . . . LUCKY IN LAS VEGAS . . . YOU WIN $300.00 . . . COLLECT FROM THE BANK . . . KEEP ON TRUCKIN . . . .
6. C.B. PASS: SAVE THIS CARD: IF YOU DRAW A SCALE CARD, PRESENT THIS CARD TO THE BANK . . . PAY NO FINE, MISS NO TURNS . . . KEEP ON TRUCKIN . . . END OF GAME VALUE, $50.00 . . . .
7. BAD LUCK: LABOR DISPUTE AT UNLOADING DOCK . . . MISS ONE TURN, TAKE ONE CHIP . . . .
8. BAD LUCK: SEVERAL TRUCKS IN FRONT OF YOU AT UNLOADNG DOCK . . . MISS ONE TURN, TAKE ONE CHIP . . . .
9. BAD LUCK: FUEL PUMP BAD . . . PAY $50.00 REPAIR BILL TO BANK . . . .
10. BAD LUCK: HEAVY TRAFFIC . . . MINOR ACCIDENT ON FREEWAY . . . SLOW DOWN . . . MISS ONE TURN, TAKE ONE CHIP . . . .
11. SAVE THIS CARD: THIS CARD ENTITLES YOU TO A $50.00 DEDUCTION ON ANY REPAIR OR ROAD SERVICE BILL . . . PRESENT THIS CARD ALONG WITH PAYMENT TO THE BANK FOR A $50.00 SAVINGS . . . END OF GAME VALUE $50.00 . . . .
12. BAD LUCK: HEAVY AND DENSE FOG . . . SLOW DOWN FOR SAFETY . . . MISS ONE TURN, TAKE ONE CHIP . . . .
13. SAVE THIS CARD: THIS CARD ENTITLES YOU TO A $50.00 DEDUCTION ON ANY REPAIR OR ROAD SERVICE BILL . . . PRESENT THIS CARD ALONG WITH PAYMENT TO THE BANK FOR A $50.00 SAVINGS . . . END OF GAME VALUE, $50.00 . . . .
14. C.B. RADIO REPORTS A CLEAN SHOT: NO BEARS, NO RADAR . . . GAIN THREE SPACES . . . KEEP ON TRUCKIN . . . .
15. C.C. PASS: C.B. REPORTS A CLEAN SHOT . . . GAIN 2 SPACES . . . NO SMOKEYS, NO RADAR . . . KEEP ON TRUCKIN . . . .
16. C.B. PASS: SAVE THIS CARD: IF YOU DRAW THIS CARD FOR A HELICOPTER PINCH, PRESENT THIS CARD . . . PAY NO FINE, MISS NO TURNS . . . END OF GAME VALUE, $50.00 . . . .
17. JACKPOT: THIS IS YOUR LUCKY DAY . . . LUCKY IN LAS VEGAS . . . YOU WIN $300.00 . . . COLLECT FROM THE BANK . . . KEEP ON TRUCKIN . . . .
18. C.B. PASS: C.B. RADIO REPORTS A CLEAN SHOT . . . GAIN 4 SPACES . . . NO SMOKEYS, NO RADAR . . . KEEP ON TRUCKIN . . . .

Stack 37 consists of 18 cards entitled "TRUCK SCALES," bearing the following instruction: 1. YOU'RE BUSTED: OVERLOADED DRIVERS . . . PAY FINE OF $50.00 TO BANK . . . MISS ONE TURN, TAKE ONE CHIP . . . REMEMBER, LOADED RIGHT MEANS A BETTER RIDE . . . .

2. YOU'RE BUSTED: I.C.C. CHECK FINDS FAULTY EQUIPMENT, MISS ONE TURN, TAKE ONE CHIP . . . .
3. YOU'RE BUSTED: OVERLOADED REAR TRAILER AXLES . . . PAY FINE OF $125.00 TO BANK . . . MISS ONE TURN, TAKE ONE CHIP . . . .
4. HEAVY AND DENSE FOG WITH REDUCED VISIBILITY, SLOW DOWN FOR SAFETY, MISS ONE TURN, TAKE ONE CHIP . . . .
5. BAD LUCK: FLASH FLOODS IN DESERT REGION . . . MISS ONE TURN, TAKE ONE CHIP . . . .
6. YOU'RE BUSTED: OVER WIDTH BY 4 INCHES . . . PAY FINE OF $25.00 TO THE BANK . . . MISS ONE TURN, TAKE ONE CHIP . . . .
7. BAD LUCK: SEVERAL TRUCKS IN FRONT OF YOU AT UNLOADING DOCK . . . MISS ONE TURN, TAKE ONE CHIP . . . .
8. BAD LUCK: FUEL SHORTAGE . . . MISS 2 TURNS, TAKE 2 CHIPS . . . WAIT FOR NEXT DELIVERY OF FUEL SHIPMENT . . . .
9. BAD LUCK: SEVERE SANDSTORM WITH HIGH WINDS . . . ROAD CLOSED . . . PAY $50.00 MOTEL BILL TO BANK . . . MISS ONE TURN, TAKE ONE CHIP . . . .
10. YOU'VE GOTTEN SLEEPY AND RUN OFF IN A DITCH . . . TRUCK SUFFERED MINOR DAMAGE . . . PAY $100.00 TOW TRUCK CHARGES AND $100.00 FOR REPAIRS . . . PAY TOTAL OF $200.00 TO THE BANK . . . MISS ONE TURN, TAKE ONE CHIP . . . .
11. BROKEN AXLE . . . PAY FINE OF $100.00 FOR REPAIRS TO THE BANK . . . .
12. YOU'RE SNOWED IN ON A MOUNTAIN PASS: PAY $300.00 FOR A SET OF LOG CHAINS PAY BANK . . . MISS 2 TURNS, TAKE 2 CHIPS . . . .
14. YOU'RE BUSTED: EXCESSIVE HEIGHT . . . PAY FINE OF $10.00 TO BANK . . . .
15. YOU'RE BUSTED: IMPROPER TIE DOWNS . . . PAY FINE OF $10.00 TO BANK . . . MISS ONE TURN, TAKE ONE CHIP . . . .
16. YOU'RE BUSTED: LOG BOOK OVER . . . PAY FINE OF $100.00 TO BANK . . . MISS ONE TURN, TAKE ONE CHIP . . . .
17. YOU'RE BUSTED: OVER LENGTH, SLIDE 5TH WHEEL AND SHORTEN UP . . . PAY FINE OF $150.00 TO BANK . . . MISS ONE TURN, TAKE ONE CHIP . . . .
18. YOU'RE BUSTED: FAULTY LIGHTING . . . PAY FINE OF $100.00 TO BANK . . . BE SURE YOUR LIGHTS ARE IN PROPER WORKING ORDER SO YOU CAN SEE AND BE SEEN . . . .
17. YOU'RE BUSTED: YOUR TRIP PERMIT HAS EXPIRED . . . PAY FINE OF $50.00 TO BANK . . . MISS ONE TURN, TAKE ONE CHIP . . . .

Stack 38 consists of 18 playing cards entitled "KEEP ON TRUCKIN CAFE," each card imprinted with instructions as follows:

1. PAY MOTEL BILL . . . BUY LUNCH AND COFFEE . . . PAY COFFEE KITTY $10.00 . . . KEEP ON TRUCKIN . . . .
2. PAY MOTEL BILL . . . BUY DINNER AND COFFEE . . . PAY $75.00 TO COFFEE KITTY . . . KEEP ON TRUCKIN . . . .
3. PAY MOTEL BILL . . . BUY DINNER AND COFFEE . . . PAY COFFEE KITTY $75.00 . . . KEEP ON TRUCKIN . . . .
4. PAY MOTEL BILL . . . BUY LUNCH AND COFFEE . . . PAY $10.00 TO COFFEE KITTY . . . KEEP ON TRUCKIN . . . .
5. YOUR TURN TO BUY COFFEE FOR THE OTHER DRIVERS . . . PAY COFFEE KITTY $10.00 . . . KEEP ON TRUCKIN . . . .
6. YOUR TURN TO BUY COFFEE FOR THE OTHER DRIVERS . . . PAY COFFEE KITTY $10.00 . . . KEEP ON TRUCKIN . . . .
7. YOUR TURN TO BUY COFFEE FOR THE OTHER DRIVERS . . . PAY COFFEE KITTY $10.00 . . . KEEP ON TRUCKIN . . . .
8. YOUR TURN TO BUY COFFEE FOR THE OTHER DRIVERS . . . PAY COFEE KITTY $15.00 . . . KEEP ON TRUCKIN . . . .
9. YOUR TURN TO BUY COFFEE FOR THE OTHER DRIVERS . . . PAY COFFEE KITTY $5.00 . . . KEEP ON TRUCKIN . . . .
10. YOUR TURN TO BUY COFFEE FOR THE OTHER DRIVERS . . . PAY COFFEE KITTY $5.00 . . . KEEP ON TRUCKIN . . . .
11. YOUR TURN TO BUY COFFEE FOR THE OTHER DRIVERS . . . PAY COFFEE KITTY $15.00 . . . KEEP ON TRUCKIN . . . .
12. YOUR TURN TO BUY COFFEE FOR THE OTHER DRIVERS . . . PAY COFFEE KITTY $10.00 . . . KEEP ON TRUCKIN . . . .
13. YOUR TURN TO BUY COFFEE FOR THE OTHER DRIVERS . . . PAY COFFEE KITTY $10.00 . . . KEEP ON TRUCKIN . . . .
14. PAY MOTEL BILL, BUY COFFEE . . . PAY $50.00 TO COFFEE KITTY . . . KEEP ON TRUCKIN . . . .
15. PAY MOTEL BILL . . . BUY COFFEE . . . PAY $50.00 TO COFFEE KITTY . . . KEEP ON TRUCKIN . . . .
16. PAY MOTEL BILL, BUY COFFEE . . . PAY $50.00 TO COFFEE KITTY . . . KEEP ON TRUCKIN . . . .
17. YOUR TURN TO BUY COFFEE FOR THE OTHER DRIVERS . . . PAY COFFEE KITTY $15.00 . . . KEEP ON TRUCKIN . . . .
18. YOUR TURN TO BUY COFFEE FOR THE OTHER DRIVERS . . . PAY COFFEE KITTY $15.00 . . . KEEP ON TRUCKIN . . . .

Stack 39 consists of 18 cards entitled "TIME", such cards bearing the following instructions:

1. YOU'RE LATE: BY 1 DAY . . . PAY FINE OF $100.00 TO BANK . . . .
2. YOU'RE ON TIME: GOOD JOB . . . KEEP ON TRUCKIN . . . .
3. YOU'RE EARLY: COLLECT $20.00 BONUS FROM THE BANK . . . GOOD JOB . . . KEEP ON TRUCKIN . . . .
4. YOU'RE EARLY: COLLECT $10.00 BONUS FROM THE BANK . . . GOOD JOB . . . KEEP ON TRUCKIN . . . .
5. YOU'RE LATE: BY 2 DAYS . . . PAY FINE OF $175.00 TO THE BANK . . . .
6. YOU'RE LATE: PAY FINE OF $15.00 TO THE BANK . . . .
7. YOU'RE EARLY: COLLECT $25.00 BONUS FROM THE BANK . . . GOOD JOB . . . KEEP ON TRUCKIN . . . .
8. YOU'RE EARLY: COLLECT $50.00 BONUS FROM THE BANK . . . GOOD JOB . . . KEEP ON TRUCKIN . . . .
9. YOU'RE ON TIME: GOOD JOB . . . KEEP ON TRUCKIN . . . .
10. YOU'RE LATE: BY 2 DAYS . . . PAY FINE OF $125.00 TO BANK . . . .
11. YOU'RE LATE: PAY FINE OF $40.00 TO BANK . . . .
12. YOU'RE LATE: PAY FINE OF $20.00 TO BANK . . . .
13. YOU'RE LATE: PAY FINE OF $25.00 TO THE BANK . . . .
14. YOU'RE ON TIME: GOOD JOB . . . KEEP ON TRUCKIN . . . .
15. YOU'RE LATE: BY 1 DAY . . . PAY FINE OF $100.00 TO BANK . . . .
16. YOU'RE EARLY: COLLECT $25.00 BONUS FROM THE BANK, GOOD JOB . . . KEEP ON TRUCKIN . . . .
17. YOU'RE ON TIME: GOOD JOB . . . KEEP ON TRUCKIN . . . .
18, YOU'RE LATE: BY 2 DAYS . . . PAY FINE OF $175.00 TO BANK . . . .

The game components further include 5 stacks of dispatch cards, 40–44. Each stack 40–44 is comprised of 5 cards and provides route instructions for one of the routes 15–19. Route cards 40 bear the following instructions:

Card No. 1: Purple Route No. 1. Load at Bangor, Maine. Proceed to Pierre, South Dakota. Make one drop there and collect $100.00. Then proceed to Salem, Oregon and collect $1200.00. Pay $500.00 for fuel costs and brokerage fees. Return to East Coast by way of Green route. Draw a time card upon reaching terminal.

Card No. 2: Green Route No. 5. Load to San Francisco, California. Proceed directly to Miami, Florida. Unload there and collect $1400.00. Pay $600.00 for fuel expenses and brokerage fees. Return to the West Coast by way of Red Route No. 2. Draw a time card upon reaching terminal.

Card No. 3: Red Route No. 2. Load Boston, Massachusetts. Go to Shreveport, Louisiana and make one drop there and collect $200.00. Then go on to Tucson, Arizona and make your final drop there and collect $1100.00. Pay $500.00 for fuel costs and brokerage fees. Go to West Coast terminal and draw a time card. Return to East Coast by way of Orange Route No. 4.

Card No. 4: Orange Route No. 4. Load Seattle, Washington. Make one drop in Helena, Montana and collect $150.00. Go to Kansas City, Missouri and make a second drop there and collect $100.00. Complete unloading in Raleigh, North Carolina and collect $1,000.00. Pay $400.00 for fuel costs and brokerage fees. Go to East Coast terminal and draw a time card. Return to West Coast by way of Blue Route No. 3.

Card No. 5: Blue Route No. 3. Load Baltimore, Maryland. Go to Colorado Springs, Colorado and make one drop there and collect $100.00. Go to San Diego, California and finish unloading and collect $1200.00. Pay $600.00 fuel costs and brokerage fees. Proceed to West Coast terminal and draw a time card. This is your last card.

Stack 41 includes 5 dispatch cards for Truck No. 2 as follows:

Card No. 1: Red Route No. 2. Load Tucson, Arizona. Go to Shreveport, Louisiana. Make one drop there and collect $200.00. Then go to Boston, Massachusetts to finish unloading and collect $1100.00. Pay $500.00 fuel expenses and brokerage fees. Continue on to East Coast terminal and draw a time card. Return to West Coast by way of Orange Route No. 4.

Card No. 2: Orange Route No. 4. Load Raleigh, North Carolina. Go to Kansas City, Missouri and make one drop there and collect $100.00. Then go to Helena, Montana and make a second drop there and collect $150.00. Then go to Seattle, Washington and finish unloading. Collect $1000.00. Pay $400.00 fuel and brokerage fees. Continue to West Coast terminal and draw a time card. Return to the East Coast by way of Purple Route No. 1.

Card No. 3: Purple Route No. 1. Load Salem, Oregon. Proceed to Pierre, South Dakota and make one drop there and collect $100.00. Go to Bangor, Maine to complete unloading. Collect $1200.00. Pay $500.00 fuel expenses and brokerage fees. Proceed to East Coast terminal and draw a time card. Return to West Coast by way of Blue Route No. 3.

Card No. 4: Blue Route No. 3. Load Baltimore, Maryland. Go to Colorado Springs, Colorado and make one drop there and collect $100.00. Then go to San Diego, California and finish unloading. Collect $1200.00. Pay $600.00 fuel costs and brokerage fees. Proceed to West Coast terminal and draw a time card. Return to East Coast by way of Green Route No. 5.

Card No. 5: Green Route No. 5. Load San Francisco, California. Proceed directly to Miami, Florida. Unload there and collect $1400.00. Pay $600.00 fuel costs and brokerage fees. Continue to East Coast terminal and draw a time card. This is your last card.

Each of the remaining stacks 42, 43, and 44 contain 5 separate cards. Each set of 5 cards is similar to the sets 40 and 41, although they contain different specific instructions.

Figure 2:
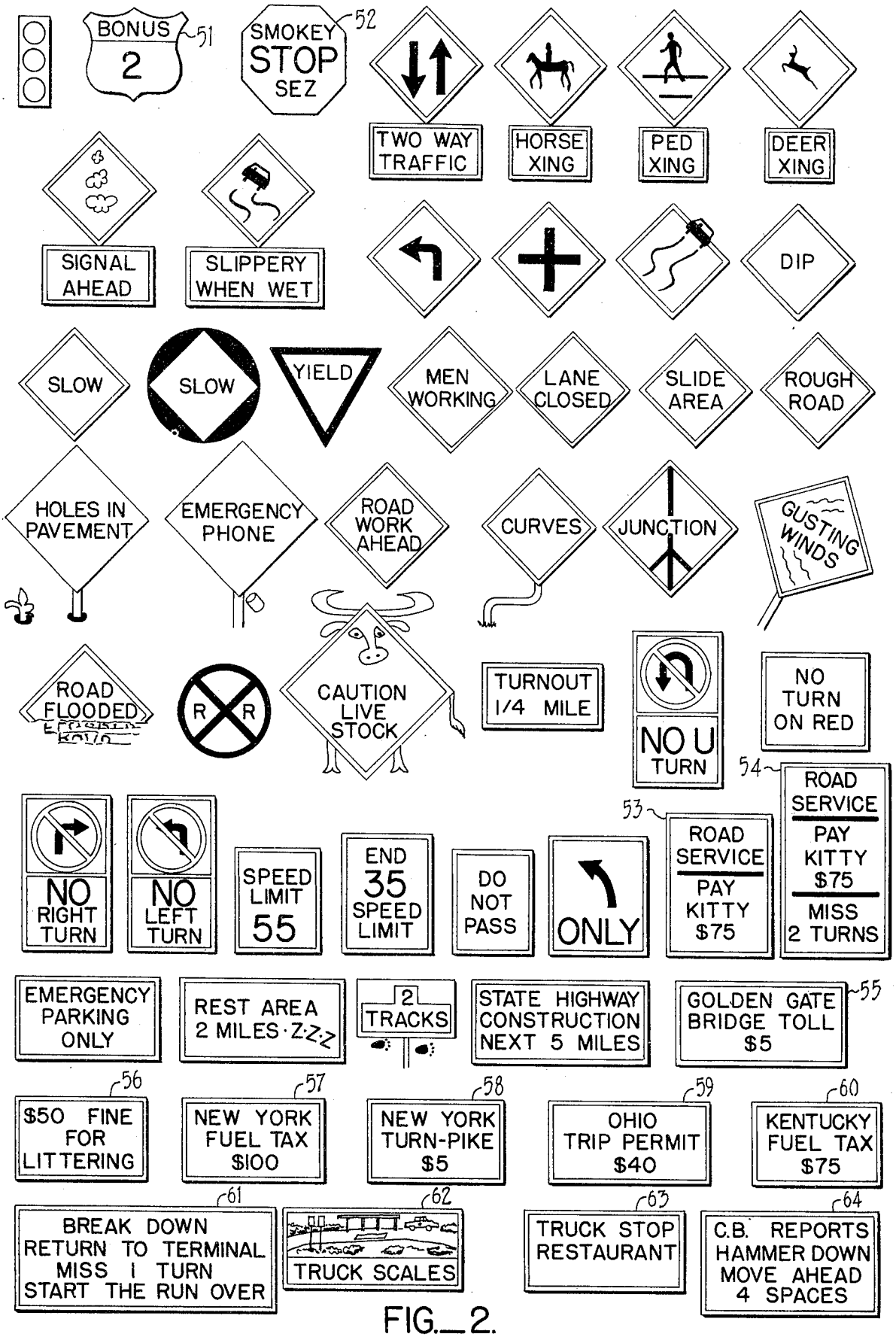
FIG. 2 depicts the indicia appearing on the various playing spaces of the playing field, i.e., those playing spaces into which the truck routes are divided.

FIG. 2 depicts a variety of instructional and non-instructional indicia which appear in the playing spaces along each of the Routes 15–19. Since the non-instructional indicia (unnumbered in FIG. 2) are primarily decorative, only the locations of the instructional indicia (numbered 51–64 in FIG. 1 and 2) are indicated in FIG. 1.

BONUS signs 51 instruct the player to draw a Bonus Card 36.

SMOKEY SEZ signs 52 instruct the player to draw a SMOKEY SEZ card 35.

Sign 53 "ROAD SERVICE" instructs the player to pay the kitty $75.00. Other Road Service signs (not shown) instruct the player to pay the kitty $100.00.

ROAD SERVICE sign 54 instructs the player to pay the kitty $75.00 and miss two turns.

LITTERING sign 56 instructs the player to pay a fine of $50.00. Another LITTERING sign, not shown, instructs the player to pay a $500.00 fine.

NEW YORK FUEL TAX sign 57 instructs the player to pay $100.00.

NEW YORK TURN PIKE sign 58 instructs the player to pay $5.00.

OHIO TRIP PERMIT sign 59 instructs the player to pay $40.00. Other State Permit signs, not shown, are as follows: South Dakota $30.00, Nevada $40.00, Montana $50.00, Texas $45.00, Utah $40.00, Missouri $35.00.

KENTUCKY FUEL TAX sign 60 instructs the player to pay $75.00. Another FUEL TAX sign, not shown, is for the State of Indiana and instructs the player to pay a Fuel Tax of $50.00.

BREAKDOWN sign 61 instructs the player to return to the terminal, miss one turn and start the run over.

TRUCK SCALES sign 62 indicates that the player should draw a Truck Scales card 37.

TRUCK STOP RESTAURANT sign 63 indicates that the player should draw a "Keep On Truckin Cafe" card 38.

CB REPORTS sign 64 indicates "HAMMER DOWN" and instructs the player to move ahead four spaces. Other CB Reports signs not shown, instruct the player to move forward two spaces.

II. GAME RULES.

The rules of the game are generally as follows:

Any number of players from two to five may play. Place the game cards 35–39, chips 34, imitation money 32, and Route Cards 40–44 around the game board as shown in FIG. 1. Select one player to act as banker to be responsible for collecting and paying all monies and dealing out appropriate game cards.

Route Cards 40–44 should be arranged in order from Card No. 1 to Card No. 5 with Card No. 1 appearing on the top of the stack. Each player selects a stack of Route Cards 40–44 and the corresponding truck. The players selecting Routes No. 1, 3 and 5 commence play with their trucks on the East Coast terminal spaces 20, 22 and 24. Players selecting Routes 2 and 4 commence play on West Coast terminal spaces 26 and 28, respectively.

The game ends when all except the last player have completed all five trips indicated on the five Route Cards. The first player to complete all five trips receives a bonus of $1,000.00 from the bank when he reaches his final terminal. The winner of the game is the player with the most money at the end of the game. Discount Cards held by a player at game's end are valued at $50.00 apiece.

Initial selection of routes is determined by roll of the die. For example, a player rolling a three with the die receives the No. 3 Route Cards. Players rolling numbers of routes previously taken must roll again.

At the start of the game, each player receives $1,000.00 in imitation money 32. Preferably, each Truck Token 31 is numbered to correspond to one of the routes, numbers 1–5.

A player who loses all of his money or is unable to pay a debt or obligation when incurred is declared bankrupt and must drop out of the game.

The player having Route No. 1 starts the game and play moves around the board in a clockwise direction.

For his turn, a player rolls the die 33 and moves his truck token 31 the number of spaces indicated on the face of the die 33. If the player lands on a space bearing one of the instructional signs 51–64, he must do as the sign instructs. If the player is instructed to lose one or more turns, he draws a corresponding number of chips 34. Each time he is passed without taking a turn, he returns one of the chips 34 so that when he has no chips left, he may resume play. The chips 34 thus serve as means for keeping track of turns forfeited.

All payments made by players for Littering, Road Service, Turn Pike or Bridge Tolls, State Permits and Fuel Taxes (which are located on the playing spaces along the Routes 15–19), and all monies paid in accordance with the "Keep On Truckin Cafe" cards are paid to the so-called "Coffee Kitty." The Coffee Kitty proceeds are kept on a space on the board (not shown) labeled "Coffee Kitty" or are otherwise segregated from funds in the bank. A player who lands on either Reno, Nevada or Las Vegas, Nevada wins all money in the Coffee Kitty.

All money paid out by players for Smokey Sez, Truck Scales, and Bonus Cards, and for mechanical repairs called for by the game cards is paid to the bank.

Two trucks cannot occupy the same space on the roadway at the same time. If one player lands on the same space as another player, approaching that player from behind, the first player to arrive on the space must go back to the space from which the second player began his turn. If the back-tracking player must go past a City for which he has collected a drop fee, he may not collect a drop fee again upon passing the City for a second time. If a back-tracking player lands on a space where he is required to draw a Play Card, he must draw the card and comply with its instuctions.

Accidents occur when one player in motion lands on an intersection 30 occupied by another player, or upon another space occupied by another player where the second player approaches the first player's token 31 from the front. In either event, the second player arriving on the previously occupied space must return in the direction from which he came a number of spaces equal to twice the number of spaces shown on the die. If a back-tracking player returns to a point behind a City for which he has previously collected drop fees, he may not collect again for that City. A player causing an accident must pay the other player damages of $100.00.

Upon entering a terminal space 20–29, only so much of the value of the die throw as is necessary to enter the terminal is utilized. Any additional count does not carry over to the next route.

Each player entering a terminal must draw a time card.

In the event that two players must leave a terminal at the same time on the same route, no accident occurs, The trucks simply are placed side-by-side and move according to the normal order of play.

The foregoing rules and description of preferred embodiments are provided for illustration. The true scope of the invention is defined by the following Claims.

I claim:

1. A trucking game, imitative of the experiences of truck drivers, comprising in combination a. a game board having a playing field comprising a plurality of routes between terminals on a map, each of said routes divided into a plurality of playing spaces, some of which bear the following types of instructional indicia:
   i. indicia calling for payment of money;
   ii. indicia calling for loss of turn;
   iii. indicia calling for the player to move ahead by a designated number of spaces; and
   iv. indicia calling for return to a prior space or to a terminal;
   v. indicia calling for the player to draw a card;

b. a plurality of route cards bearing the following types of instructional indicia:
   i. indicia calling for the player to cross the board on a particular route;
   ii. indicia calling for the player to take on loads at particular locations along said route called for;
   iii. indicia calling for the player to drop off all or part of a load at particular locations along said route called for;
   iv. indicia calling for receipt of money upon dropping off all or part of load as called for; and
   v. inidica calling for payment of money for specified purposes;

c. a plurality of chance cards bearing the following types of instructional indicia:
   i. indicia instructing the player to move forward or backwards a designated number of spaces;
   ii. indicia instructing the player to receive or pay money; and
   iii. indicia instructing the player to miss a turn or turns; and d. a plurality of time cards bearing the following types of instructional indicia:
   i. pay penalty for late arrival; and
   ii. receive bonus for early arrival; and e. a plurality of playing pieces representing trucks suited for movement along said routes;

f. means for randomly designating the initial number of spaces to be moved by a player in a given turn; and g. imitation money for carrying out transactions calling for payment and receipt of money.

2. The trucking game recited in claim 1 wherein said routes cross one another at intersections.

3. A trucking game, imitative of the experience of truck drivers, comprising in combination a. a game board having a playing field comprising
   a map;
   a plurality of terminals; and
   a plurality of routes across said map, each route extending between a pair of terminals, said routes divided into a plurality of playing spaces, some of which bear instructional indicia calling for the following events: selection of a certain one or more of said routes to be followed by the player in moving about said playing field, payment or receipt of money by the player, delay or advancement of the progress of a player's token along said routes, and selection of one of a plurality of cards by the player;

b. a plurality of said cards from among which a player draws one or more cards bearing indicia instructing said player, thereby providing randomly selected instructions to players;

c. a plurality of playing tokens representing trucks for marking a player's location on the playing field;

d. means for randomly designating the number of playing spaces to be moved by a player along one of said routes during the player's turn; and e. imitation money for carrying out transactions calling for payment or receipt of money.

4. The game of claim 3 wherein the instructional indicia appearing on said plurality of cards comprises instructions calling for one or more of the following events:

a. payment or receipt of money by the player;

b. delay or advancement of the progress of the player's token along said routes; and c. selection of a certain one or more of said routes to be followed by the player in moving about said playing field.

5. The game board of claim 4 wherein said routes cross one another at intersections.

6. The game board of claim 3 wherein said plurality of cards comprise calling for route cards bearing said instructions calling for selection of one or more of said routes; and chance cards bearing said instructions for payment or receipt of money, and delay or advancement of token progress.

7. The game board of claim 6 wherein said routes cross one another at intersections.

8. The trucking game of claim 6 wherein said game board further has commercial indicia on or adjacent said playing field, said commercial indicia bearing the trade symbols of manufacturers and/or suppliers of goods and/or services for the trucking industry.

9. The trucking game of claim 7 wherein said game board further has commercial indicia on or adjacent said playing field, said commercial bearing the trade symbols of manufacturers and/or suppliers of goods and/or services for the trucking industry.

10. The game board of claim 3 wherein said routes cross one another at intersections.

11. The game board of claim 3 wherein said routes cross one another at intersections.

12. The trucking game of claim 1 wherein said game board further has commercial indicia on or adjacent said playing field, said commercial indicia bearing the trade symbols of manufacturers and/or suppliers of goods and/or services for the trucking industry.

* * * * *